United States Patent [19]

Herrold

[11] 4,424,022

[45] Jan. 3, 1984

[54] METHOD OF USING CERAMIC GREENWARE SUPPORT

[75] Inventor: Lear C. Herrold, Derry, Pa.

[73] Assignee: Westinghouse Electric Corp., Pittsburgh, Pa.

[21] Appl. No.: 348,898

[22] Filed: Feb. 16, 1982

Related U.S. Application Data

[62] Division of Ser. No. 158,089, Jun. 10, 1980, Pat. No. 4,330,270.

[51] Int. Cl.[3] ..... F27D 5/00; F23J 15/00

[52] U.S. Cl. ..... 432/5

[58] Field of Search ..... 432/5, 258, 259; 264/57, 58

[56] References Cited

U.S. PATENT DOCUMENTS

| | | | |
|---|---|---|---|
| 1,893,314 | 1/1933 | Willetts | 432/258 |
| 2,543,549 | 2/1951 | Jeppson | 432/258 |
| 3,179,724 | 4/1965 | Jones | 432/5 |
| 3,904,352 | 9/1975 | Thurnauer et al. | 432/259 |
| 3,948,594 | 4/1976 | Irwin, Jr. | 432/259 |

FOREIGN PATENT DOCUMENTS

| | | | |
|---|---|---|---|
| 571092 | 8/1945 | United Kingdom | 432/258 |

*Primary Examiner*—John J. Camby
*Attorney, Agent, or Firm*—L. P. Johns

[57] ABSTRACT

Apparatus for firing ceramic greenware including a container and a plurality of independently movable granules disposed within the container so as to provide a readily levelable minimum friction support surface for supporting the ceramic greenware. During firing, those granules which contact the greenware move in correspondence with the shrinkage of the greenware so that friction related distortion of the greenware is reduced. The ceramic greenware is fired by a method which includes providing a sufficient depth of granules to permit relative movement of those granules in contact with the ceramic greenware, leveling the surface of the granules, placing the greenware on the level surface and firing the ceramic greenware.

4 Claims, 4 Drawing Figures

METHOD OF USING CERAMIC GREENWARE SUPPORT

This is a division of application Ser. No. 158,098, filed June 10, 1980, now U.S. Pat. No. 4,330,270.

BACKGROUND OF THE INVENTION

1. Field of the Invention

The invention relates in general to the firing of ceramic greenware and more particularly to apparatus for supporting ceramic insulator greenware to prevent distortion of same during the firing process.

2. Description of the Prior Art

Ceramic greenware is subject to shrinkage during the firing process. Because of this, the surface upon wich the ceramic greenware resides, i.e., the load bearing surface, is subject to distortion due to friction between the load bearing surface and the support surface upon which the greenware resides. This distortion due to shrinkage or contraction of the greenware during the firing process becomes critical for ceramic insulator greenware in particular, because the ceramic insulator greenware is supported during the firing process on a portion of the insulator that later is used for insertion into the mounting flange ring of a transformer or other electrical apparatus where ceramic insulator bushings are employed. A small amount of distortion then of a ceramic insulator load bearing surface causes the fired insulator to be unsuitable for mounting in the end use electrical apparatus. A known solution of the prior art to alleviate this distortion problem is the use of an unfired setter plate disposed between a fired setter plate and the load bearing surface of the ceramic greenware. The unfired setter plate then contracts uniformly with the ceramic greenware since both are greenware. The load bearing surface of the ceramic greenware is not required to slide over the support surface and no distortion occurs. The disadvantages of this method are the increased labor necessary to level the setter plates prior to firing of the ceramic greenware and the increased material cost because it is necessary to scrap the green setter plate after it has been fired. Only green setter plates are suitable for uniform contraction with the load bearing surface of the ceramic greenware. The increased labor to level the green setter plate as well as the waste materials resulting from throwing away the green setter plate after firing add to the cost of the final fired ceramic insulator product. Accordingly, it would be desirable to provide a reusable greenware support that would provide a level support surface for the load bearing surface of the greenware that would allow shrinkage of the greenware load bearing surface during firing so as to prevent distortion.

SUMMARY OF THE INVENTION

Briefly, the present invention is a reusable support arrangement that provides a minimum friction support surface for the load bearing surface of ceramic greenware, and in particular ceramic insulator greenware, that provides a readily leveled surface for supporting said ceramic greenware and allows shrinkage of the greenware without distortion during the firing process. This minimum friction support surface is provided by means of granules and in particular, according to a preferred embodiment of the invention, spherically-shaped granules that allow movement of at least those granules in contact with the ceramic greenware load bearing support surface. A method for using the support arrangement of the invention is also disclosed.

The support arrangement according to the teachings of the invention presents a readily leveled support surface for supporting the ceramic greenware thereby eliminating the tedious labor requirement for leveling the support arrangements of the prior art. The ceramic greenware support arrangement provides a minimum friction support surface such that the ceramic greenware load bearing surface may readily slide over the minimum friction support surface and therefore contract uniformly during the firing operation.

BRIEF DESCRIPTION OF THE DRAWINGS

The invention may be understood and further advantages and uses thereof more readily appreciated when considered in view of the following detailed description of exemplary embodiments, taken with the accompanying drawings, in which.

DESCRIPTION OF THE PREFERRED EMBODIMENTS

Figure 1:
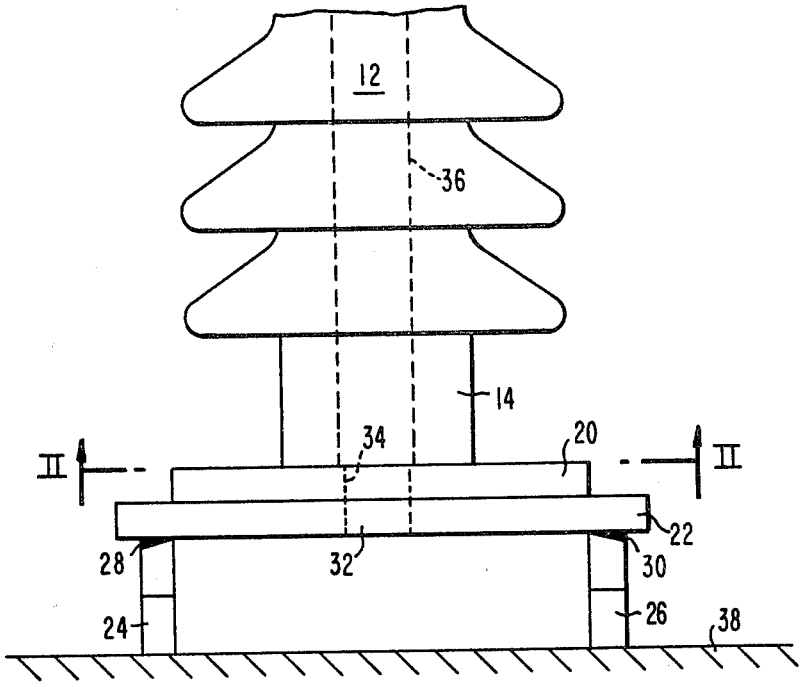
PRIOR ART FIG. 1
FIG. 1 is an elevational view of a typical support arrangement of the prior art shown supporting a typical ceramic insulator greenware.

Throughout this description, like elements will be identified with like numerals. Referring now to the drawings, and FIG. 1 in particular, there is shown an elevational view of a prior art support arrangement 10, shown supporting typical ceramic insulator greenware 12. Ceramic insulator 12 includes mounting portion 14 which is inserted into an associated mounting flange, (not shown) or inserted directly into an opening in a transformer tank (not shown), reactor or other electrical apparatus during the assembly of such apparatus. Consequently, it is this mounting portion 14 of ceramic insulator greenware 12 that must be produced and maintained during the firing process to a close tolerance so that it is easily insertable into the end use product which the ceramic insulator is mounted on.

Figure 2:
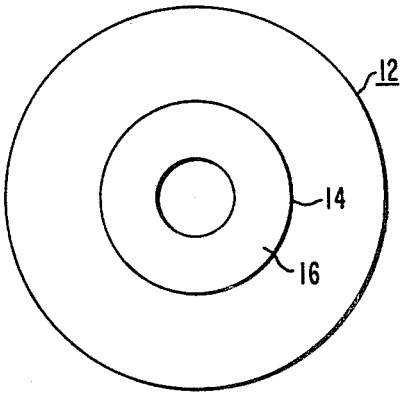
FIG. 2 is a bottom view of the ceramic insulator greenware shown in FIG. 1.

A bottom view of ceramic insulator greenware 12 is shown in FIG. 2 showing the bottom surface 16 of mounting portion 14 of ceramic insulator greenware 12. It is the bottom surface, such as surface 16, of ceramic insulators that the greenware is supported on during the firing process, making surface 16 a load bearing surface. It is this same load bearing surface 16 which must be kept to a very high tolerance as discussed above so that ceramic insulator 12 after firing may be readily inserted into a mounting flange. As is well known in the art, ceramic insulator greenware 12 including load bearing support surface 16 will shrink or contract substantially during the firing process. Where load bearing support surface 16 to be disposed on a standard supporting surface such as the floor of the kiln, it would not contract uniformly due to friction between the load bearing surface 16 and the supporting structure thereby causing load bearing surface 16 to be subject to distortion and unsuitable for use as an insulator on electrical apparatus.

It is this distortion that must be protected against and support arrangements of the prior art such as support arrangement 10 have been designed to minimize this firing distortion of the load bearing surface.

One known means for reducing this distortion is shown in support arrangement 10 wherein green setter plate 20 is disposed on fired setter plate 22, which fired setter plate 22 is supported by a plurality of columns such as columns 24 and 26 which are generally of standard fire brick. In this way, green center plate 20 contracts uniformly with load bearing support surface 16 during the firing operation thereby preventing friction related distortion of load bearing support surface 16.

It is critical during the firing operation to support ceramic insulator greenware 12 perfectly level so that gravity induced distortion does not occur. For this reason, support arrangement 10 is leveled by means of inserting a suitable refractory clay shown generally at 28 and 30 between the support columns such as columns 24 and 26 and the fired setter plate such as setter plate 22.

One type of kiln that is used to fire ceramic greenware is a down-draft kiln wherein the heat is distributed under the floor of the kiln and rises due to gravity up through the chamber of the kiln. For this reason, both the green and fired setter plates 20 and 22, have apertures such as aperture 32 and 34, respectively, so as to form a heat flue to conduct heat from the floor of the kiln shown generally at 38 through the interior of ceramic insulator greenware 12.

From the discussion of the prior art arrangements for supporting ceramic insulating greenware, it can be appreciated that any support arrangement must have the following characteristics: (1) the support arrangement must be adaptable for providing a readily leveled support surface, (2) the support arrangement must provide a minimum friction support surface such that when the ceramic greenware load bearing surface is disposed upon the support surface, upon subsequent firing of the ceramic greenware, the load bearing surface may readily slide over the support surface and therefore shrink or contract uniformly during the firing operation, and (3) to be usable in certain types of down-draft kilns, the support surface must have a means for providing a flue for the heat to rise and circulate through the interior of the ceramic greenware.

Figure 4:
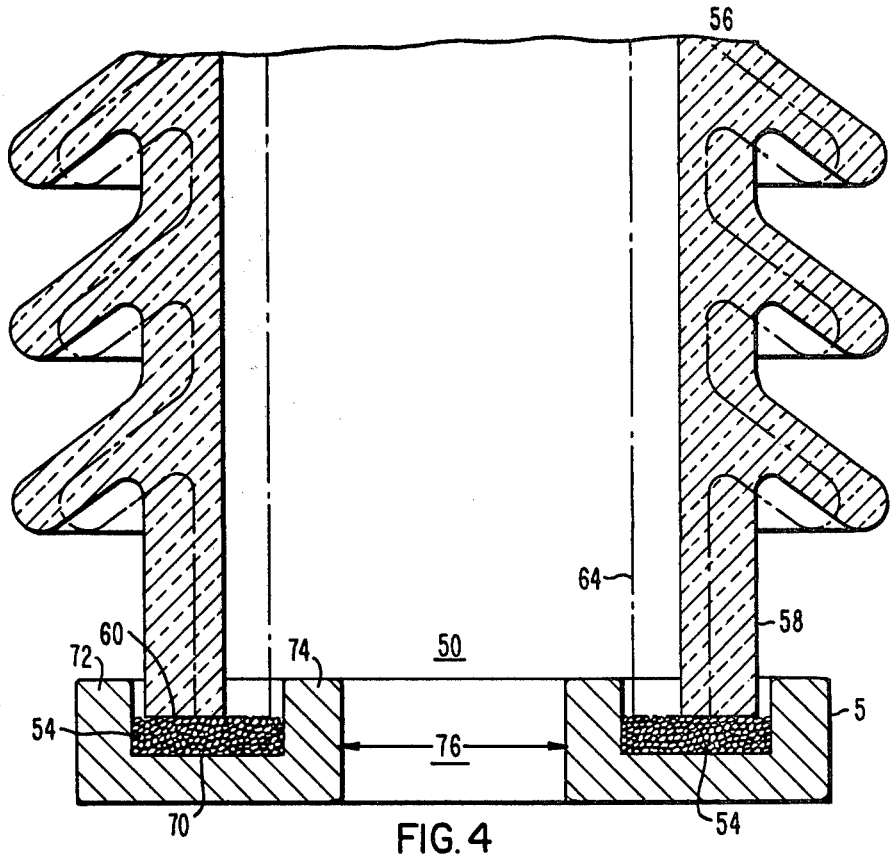
FIG. 4 is a cross-sectional view of the apparatus of FIG. 3 shown supporting a typical ceramic insulator greenware, portions of the fired insulator being shown drawn in phantom.
Figure 3:
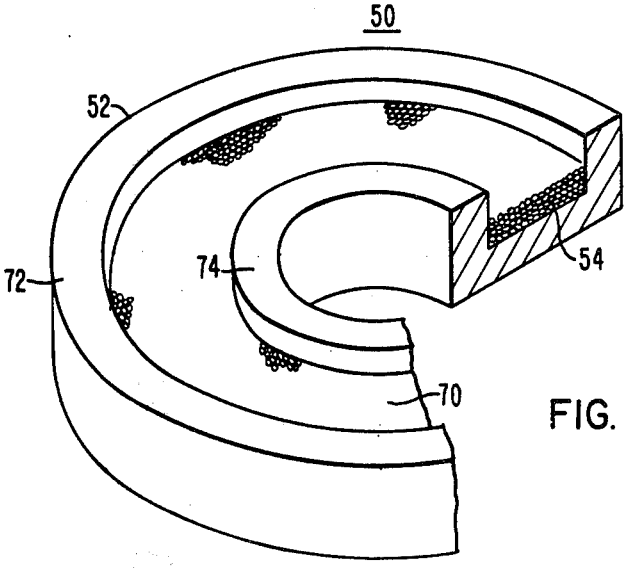
FIG. 3 is an isometric view of apparatus for supporting ceramic greenware according to the teachings of the invention.

Support arrangement 50 shown isometrically in FIG. 3 and in cross-section in FIG. 4 satisfies all of these characteristics by providing a minimum friction support surface that is readily leveled. Support arrangement 50 includes container 52 wherein there is disposed a plurality of independently movable granules 54 upon which ceramic insulator greenware 56 resides. Ceramic insulator greenware 56 includes mounting portion 58 and load bearing surface 60 disposed upon and supported by the independently movable granules 54. Those granules 62 which contact the ceramic insulator greenware load bearing surface 60 move in correspondence with the contraction of the greenware during the firing operation so that friction related distortion of ceramic greenware load bearing surface 60 is reduced or eliminated. The independently movable granules function as mini ball bearings to provide a minimum friction support surface so that the ceramic greenware load bearing surface 60 may readily slide over support surface 62 and therefore contract uniformly during the firing operation. Mounting portion 58 of ceramic insulator greenware 56 would assume the position shown drawn in phantom at 64 after firing.

The independently movable granules 54 may be common silica sand or other type of granules that readily move relative to one another when support surface 60 is shrinking or contracting during the firing of ceramic greenware 56. According to a preferred embodiment of the invention, the granules are much more disposed to function as mini ball bearings and move relative to one another when they have a spherical configuration. Silica sand with this spherical configuration is available under the trademark UNSEL by the Uniman Corporation of New Canaan, Conn. This particular type of silica sand has been used in the preferred embodiment with excellent results when disposed in a container such as container 52 to a depth of approximately one inch.

Referring again now to FIGS. 3 and 4, the independently movable granules 54 are supported by support means or container 52 which may be a sand setter made of a suitable material for withstanding, and will be reusable at the end of, the firing process. A sand setter or container made of cordiorite, a high temperature refractory material made from magnesium, aluminum and silicate, has been used in the preferred embodiment with excellent results. Sand setter or container 52 includes a base 70, exterior peripheral wall 72, and interior peripheral wall 74. Base 70 along with interior and exterior peripheral walls 74 and 72, respectively, would be manufactured from a high temperature refractory material such as cordiorite and would be manufactured to have the general configuration (with a larger support surface area) of the ceramic greenware load bearing surface that the independently movable granules such as granules 54 would support during the firing operation. Container or sand setter 52 would also be manufactured so as to contain the depth of individually movable granules 54 necessary to prevent distortion of the ceramic greenware load bearing surface. Interior peripheral wall 74 of sand setter or container 52 forms a flue 76 for conduction of heat up through the interior of ceramic insulator greenware 56 so that sand setter or container 52 may be placed directly on the floor of a down-draft kiln.

In preparation for the firing operation of the ceramic greenware such as ceramic greenware 56, the independently movable granules 54 would be disposed in a suitable container such as sand setter 52 to a sufficient depth to permit relative movement of at least those granules in contact with the greenware so as to minimize distortion of the greenware when the greenware contracts during the firing process. The independently movable granules 54 would have their surface leveled by any leveling means that may be employed in a commercial operation. Independently movable granules 54 are readily leveled by means of a rowel-type of tool (not shown) which is brushed along the top surface of the movable granules at a uniform height. The ceramic greenware such as greenware 56 would then be placed on the level surface of the independently movable granules and the greenware would then be fired in a suitable kiln.

In conclusion, the apparatus for supporting ceramic greenware according to the teachings of the invention has the advantages of providing a readily leveled, minimum friction support surface wherein independently movable granules are disposed such that those granules which contact the greenware move in correspondence with the shrinkage of the greenware thereby reducing friction-related distortion of the fired greenware. The interior peripheral wall of the sand setter or container according to the teachings of the invention forms an inherent flue for the conduction of heat up through the interior of the ceramic insulator greenware. The sand setter or container according to the teachings of the invention is suitable for placing directly on the floor of down-draft kilns. Therefore, the brick and leveling clay arrangement of the prior art is no longer necessary. Since the support apparatus according to the teachings of the invention is completely reusable, waste material resulting from firing is eliminated.

Although ceramic insulator greenware was illustrated throughout the foregoing description of preferred embodiments, because the present invention was developed to, and solved certain problems related to the production of ceramic insulators, the invention is not limited to the firing of ceramic insulators. Rather, the invention is broadly applicable to the firing of ceramic greenware wherein a readily leveled minimum friction support surface is desired to minimize or eliminate friction-caused distortion of the fired product.

I claim:

1. A method for firing ceramic greenware, comprising the steps of:

(a) providing a sufficient depth of granules alone in a concave surface of a container to support said greenware thereon and to permit relative movement of at least those granules in contact with said greenware so as to minimize distortion of said greenware when said greenware shrinks during the firing thereof;

(b) leveling the surface of said sufficient depth of granules;

(c) placing said greenware on said level surface; and (d) firing said greenware.

2. The method of claim 1 wherein said granules comprise silica sand.

3. The method of claim 2 wherein said silica sand granules have a substantially spherical configuration so that said relative movement is one of rotation.

4. The method of claim 1 wherein said granules are generally spherically shaped granules of silica sand which rotate relative to each other.

* * * * *